169-45 SR
11/9/76 OR 3,990,517

United States Patent [19]
Lewer

[11] 3,990,517
[45] Nov. 9, 1976

[54] PREVENTION OF SELF-IGNITION (SPONTANEOUS IGNITION) OF COAL THROUGH THE USE OF CALCIUM OR MAGNESIUM CHLORIDE WITH ADDITION OF A WETTING AGENT

[75] Inventor: Hans Lewer, Witten-Annen, Germany

[73] Assignee: Chemische Fabrik Kalk GmbH, Germany

[22] Filed: Apr. 8, 1975

[21] Appl. No.: 566,604

[30] Foreign Application Priority Data

Apr. 20, 1974 Germany ..... 2419144

[52] U.S. Cl. ..... 169/45; 169/64
[51] Int. Cl.[2] ..... A62C 2/00; A62C 3/00
[58] Field of Search ..... 169/43–46, 169/48, 49, 54, 64; 252/2; 299/12

[56] References Cited

UNITED STATES PATENTS

| | | | |
|---|---|---|---|
| 2,063,761 | 12/1936 | Scholz | 299/12 |
| 2,786,815 | 3/1957 | Buggisch et al. | 299/12 X |
| 2,924,279 | 2/1960 | Hofbauer et al. | 169/44 |
| 3,837,404 | 9/1974 | Buggisch et al. | 169/45 |

FOREIGN PATENTS OR APPLICATIONS

| | | | |
|---|---|---|---|
| 2,129,462 | 5/1973 | Germany | 169/45 |
| 6,343 | 5/1913 | United Kingdom | 169/45 |

*Primary Examiner*—John J. Love
*Assistant Examiner*—Andres Kashnikow
*Attorney, Agent, or Firm*—Laurence & Neilan

[57] ABSTRACT

A new process has been devised for the application of a mixture of calcium or magnesium chloride and a non-ionogenic wetting agent for the prevention of the spontaneous ignition of coal, especially during underground mining operations, by applying the same to the surface of the coal. The process involves boring of holes into the out-cropping coal and then forcing the mixture of calcium or magnesium chloride and wetting agent in an aqueous solution which contains 25 to 35% by weight of the mixture through the bore holes. A constant quantity of about 3 to 6 liters of solution per minute is pressed into the bore holes, the pressure being only sufficient to overcome the counter pressures occurring in the coal. The procedure greatly extends the time of effectiveness of the prevention of spontaneous ignition of the coal and eliminates to a large extent the expenditure of labor for supervision and retreatment of the surface of the coal now being experienced.

4 Claims, No Drawings

PREVENTION OF SELF-IGNITION (SPONTANEOUS IGNITION) OF COAL THROUGH THE USE OF CALCIUM OR MAGNESIUM CHLORIDE WITH ADDITION OF A WETTING AGENT

In my German Pat. No. 2,129,462 filed June 14, 1971 and issued Dec. 6, 1973 there is disclosed and claimed the use of a quantity of calcium or magnesium chloride and a nonionogenic wetting agent in powder form for the prevention of the spontaneous igniton of coal, especially during underground mining operations by applying the dry mixture to the surface of the coal. The wetting agent in that patent is especially in the form of dialkyl phenyl polyglycol ether with 5 to 20 glycol radicals in the glycol ether group and of alkyl groups with 1 to 9 C atoms, or as a mixture of dialkyl phenyl polyglycol ethers with 5 to 20 glycol radicals in the glycol ether group and of alkyl groups with 1 to 9 C atoms and other alkyl, aryl or alkyl aryl polyglycol ethers in the quantities of 0.5 to 5.0% by weight, and possibly additionally of an agent containing a finely distributed inner substance in quantities of 0.1 to 5.0% parts by weight per part by weight of hygroscopic salt.

The effectiveness of this composition or mixture, although it is only applied to the surface of the coal, is nevertheless not limited at all strictly to the surface. Rather a concentrated solution is formed within a short time after application as a result of the hygroscopic characteristics of the calcium or magnesium chloride contained in the mixture from the moisture of the surrounding air and the wetting agent, which solution has been found to penetrate under the action of the wetting agent through the smallest pores and fissures even into the coal. However, this penetrating effect is limited and only reaches up to a penetrating depth of about 20 to 100 cm, depending on the porosity of the coal and the number of treatments carried out.

Such a wetted and saturated layer is in a position to prevent the spontaneous combustion of the coal so long as this layer is maintained undisturbed and uninterrupted. However, whenever this saturated layer is broken or decomposed in places as a result of external influences, or whenever new fissures and flaws develop in large numbers in the treated outcropping coal, as a result of rock pressure, which fissures may reach deep into the solid coal, then it will be necessary to treat the newly formed or exposed surfaces of the coal once again with this mixture. Protection against spontaneous combustion for the future is thus guaranteed only as a result of repeated treatments. In these cases continuous supervision and usually repeated applications of the mixture are required at the endangered places in order to maintain the desired effect.

Therefore attempts have been made to find a possibility of considerably reducing the expenditure in labor for supervision and retreatment of the surface of the coal.

It is therefore the object of the present invention in the use of a mixture containing principally calcium or magnesium chloride and a quantity of non-ionogenic wetting agents, which are present especially as dialkyl phenyl polyglycol ether with 5 to 20 glycol radicals in the glycol ether group and of alkyl groups with 1 to 9 C atoms or as a mixture of dialkyl phenyl polyglycol ethers with 5 to 20 glycol radicals in the glycol ether group and of alkyl groups with 1 to 9 C atoms and of other alkyl, aryl or alkyl aryl polyglycol ethers, in quantities of 0.5 to 5.0% by weight, for the prevention of spontaneous combustion of coal during underground mining according to German Pat. No. 2,129,462, wherein the improvement consists of forcing the mixture through bore holes into the outcropping coal in the form of an aqueous solution which contains 25 to 35% by weight of the mixture.

Such aqueous solutions which contain the composition or mixture of the German patent in quantities of from 25 to 35% by weight can be introduced into the outcropping coal by means of a saturating arrangement, as used for example also for face-saturation. At the same time it is important to press or force the solution into the pertinent bore holes only with a pressure which is barely sufficient for overcoming the counter pressure occurring in the coal. In this manner, one will prevent to a large extent the formation of additional fissures from occurring unnecessarily which may enlarge the surface of the coal and thus the danger of spontaneous combustion. Although the counter pressures existing in the coal can be of variable intensity, it turned out to be advantageous not to change the continuous pressing in pressure of the solution used according to the invention, but to press (force) a constant quantity of about 3 to 6 liters of solution per minute into the bore holes located in the face, whereby pump pressures of about 5 to 300 atu can occur. The quantity of the solution that is to be used always within these limits is dependent on the porosity and the absorption capacity of the coal to be treated.

The production of the aqueous solution according to the invention can be accomplished in various ways. In the most simple case the solution ready for use is produced in a suitable mixing vessel by dissolving the mixture according to the said patent in the required volume of water and it is taken from this vessel directly by the saturating pump. In case of a larger need of saturatng solutions it may be more advantageous to produce an essentially more concentrated solution of the mixture, to connect the saturating pump with a water supply system and to add the concentrated solution in a precalculated quantity by means of dosing pumps to the water flowing therethrough. Finally, it is also possible to produce the mixtures from solid calcium or magnesium chloride and wetting agent in the form of cylindrical saturating cartridges, which are either introduced into the bore hole where they slowly dissolve in the pressed in saturating water, or in a container through which the entire or a partial volume of the saturating water flows. In each case, one must regulate the dissolution speed by a corresponding shaping of the surface of the cartridge in such a way, that a saturation liquid of the stated concentration develops.

The following are a few examples to illustrate in more detail the process according to the invention.

EXAMPLE 1

In a layer of 2.50 m width, there remained a solid coal seam of 40 m length and 60 m depth. The solid block of coal would be ventilated during the entire duration of the mining of the working. Because of the increasing rock pressure on this solid block of coal, it became crushed more and more. As a result, there existed the danger that in the loosened coal some spontaneous combuston might occur. After the outside surfaces of the solid block of coal had at first been treated with the mixture according to the German patent, holes substantially equidistant from each other of from 4 to 6 m were drilled to a depth of 8 to 12 m into the coal. An aqueous solution which contained 30% by weight of $CaCl_2$ and 0.5 by weight of a commercially obtainable wetting agent of the composition described in the German patent was forced under adequate pressure subsequently into each of these bore holes. The volume of solution per bore hole amounted to an average of approximately 400 liters, the saturation time was approximately 90 minutes. During a period of observation of 10 months, no noteworthy increase of CO content of the atmosphere occurred, which would have given rise to drawing a conclusion of a beginning spontaneous combustion condition existing in this part of the mining operation.

EXAMPLE 2

In a section a new headroom was started to be cut in the backwork. The former top road of the headroom lying below at the same time served as the base road for the new mining operations. Sine pillars of coal had remained standing in the lower headroom, the road during mining of the lower headroom had been gunited in order to avoid clandestine currents of air. With continuing mining of the new headroom the support of the present base road was removed, as a result of which an airproof closure did no longer exist. In addition, one had to take into account the fact that as a result of the rock pressure developing during the mining, the pillars of coal which had remained standing during the mining of the lower headroom were crushed evermore. Since the seam of fat coal is considered to be subject to danger from combustion anyway, there then existed the danger of spontaneous combustion occurring.

As a result of the guniting of the track, a treatment with the agent according to the German patent was not possible. Therefore, prior to mining, bore holes were driven through the guniting into the outcropping coal pillars, which holes reached at least half the depth of the coal pillars and had a mutual distance of about 6 m. An aqueous calcium chloride solution according to the invention and containing a wetting agent was forced under pressure into these holes. At the same time, a quantity of about 5 liter per $m^3$ of coal was used. The rate of feed amounted to 3 liters of the solution per minute. In this case too, during a time period of 10 months, no unusual increase of CO content of the atmosphere was observed.

What is claimed is:

1. A process for the prevention of spontaneous combustion of coal in underground mining operations which comprises the steps of boring holes of substantial depth into the outcropping coal, and forcing under pressure an aqueous solution containing a mixture of calcium or magnesium chloride and a non-ionogenic wetting agent selected from the group consisting of dialkyl phenyl polyglycol ethers having 5 to 20 glycol radicals in the glycol ether group and 1 to 9 carbon atoms in the alkyl groups or mixtures of said dialkyl phenyl polyglycol ethers with other alkyl, aryl or alkyl aryl polyglycol ethers through the bore holes into the outcropping coal, said solution containing 25 to 35% by weight of said chloride and wetting agent mixture, said wetting agent being present in quantities of 0.5 to 5.0% by weight.

2. A process according to claim 1, wherein the pressing in of the solution into the bore holes is carried out under a pressure at which 3 to 6 liters of solution are absorbed per minute and bore hole by the coal.

3. A process according to claim 1, wherein the pressing in of the solution into the bore holes is carried out under a pressure at which 3 to 6 liters of solution are absorbed per minute and bore hole by the coal.

4. A process according to claim 1, wherein said aqueous solution consists essentially of water, calcium or magnesium chloride, and said non-ionogenic wetting agent.

* * * * *